US009383724B2

(12) United States Patent
Rebetez

(10) Patent No.: US 9,383,724 B2
(45) Date of Patent: Jul. 5, 2016

(54) FAST CORRECTION SYSTEM FOR CALENDAR INFORMATION

(71) Applicant: Omega SA, Biel/Bienne (CH)
(72) Inventor: Olivier Rebetez, Rossemaison (CH)
(73) Assignee: Omega SA, Biel/Bienne (CH)

( * ) Notice: Subject to any disclaimer, the term of this patent is extended or adjusted under 35 U.S.C. 154(b) by 0 days.
(21) Appl. No.: 14/715,942
(22) Filed: May 19, 2015
(65) Prior Publication Data
US 2015/0346689 A1 Dec. 3, 2015
(30) Foreign Application Priority Data
May 28, 2014 (EP) ..... 14170295
(51) Int. Cl.
*G04B 19/253* (2006.01)
*G04B 13/02* (2006.01)
*G04B 19/22* (2006.01)
*G04B 19/25* (2006.01)
*G04B 19/26* (2006.01)
*G04B 27/00* (2006.01)
(52) U.S. Cl.
CPC ..... *G04B 19/253* (2013.01); *G04B 13/02* (2013.01); *G04B 19/22* (2013.01); *G04B 19/25* (2013.01); *G04B 19/26* (2013.01); *G04B 27/00* (2013.01)
(58) Field of Classification Search
CPC ..... G04B 19/22; G04B 19/24; G04B 19/25; G04B 19/26; G04B 19/25326; G04B 19/25306; G04B 27/00; G04B 47/003; G04B 19/253; G04B 13/02
See application file for complete search history.

(56) References Cited

U.S. PATENT DOCUMENTS

2004/0130970 A1* 7/2004 Watanabe ..... G04B 19/25373 368/37
2005/0128875 A1 6/2005 Bron
2005/0162983 A1* 7/2005 Hirano ..... G04B 19/25 368/190
2007/0195649 A1* 8/2007 Crettex ..... G04B 19/241 368/34
2008/0106979 A1* 5/2008 Bron ..... G04B 19/25 368/34
2008/0144444 A1* 6/2008 Mahler ..... G04B 27/005 368/76
2010/0027381 A1* 2/2010 Mahler ..... G04B 19/02 368/28
2012/0243381 A1* 9/2012 Goeller ..... G04B 27/005 368/34
2013/0176827 A1* 7/2013 Zaugg ..... G04B 19/262 368/15
2013/0201801 A1* 8/2013 Calabrese ..... G04B 19/25 368/34
2013/0250737 A1* 9/2013 Villar ..... G04B 19/25 368/15

FOREIGN PATENT DOCUMENTS

EP 1 544 691 A1 6/2005

OTHER PUBLICATIONS

European Search Report issued Mar. 11, 2015 in European Application 14170295, filed on May 28, 2014 (with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

The invention relates to a system of measuring a piece of time related information connected to a display system for displaying the piece of time related information and to a fast correction system for correcting the time related information display at any time and in a predetermined step.

13 Claims, 4 Drawing Sheets

FAST CORRECTION SYSTEM FOR CALENDAR INFORMATION

This application claims priority from European Patent Application No. 14170295.1 filed May 28, 2014, the entire disclosure of which is hereby incorporated herein by reference.

FIELD OF THE INVENTION

The invention relates to a system for the fast correction of calendar information, making it possible to make a correction in predetermined steps in a minimal volume.

BACKGROUND OF THE INVENTION

Display systems are widely used in horology. Mechanisms currently used for display are dragging, instantaneous or semi-instantaneous mechanisms. Current systems can make it difficult to correct the display such as the calendar close to a change of the display and require a safety device to be used to avoid damage. Moreover current correction devices may cause stress in the gear train when the display is corrected.

SUMMARY OF THE INVENTION

It is an object of the present invention to overcome all or part of the aforecited drawbacks by proposing a very compact fast correction or setting system capable of correcting a calendar display at any time without generating stress on the time measurement system to which it is coupled.

To this end, the invention relates to a timepiece mechanism including a time measurement system and a calendar system connected to the time measurement system, the time measurement and calendar systems each being connected to a display system for displaying at least one time related value and at least one calendar related value, and a fast correction system for correcting at any time and in predetermined steps said display of said at least one calendar value while maintaining the connection of the display system to the time measurement and calendar system during the correction phase, characterized in that the correction system includes a correction wheel set connected to the display system, a drive wheel mounted for free rotation on said correction wheel set and permanently connected to the time measurement system, and elastic coupling means between the correction wheel set and the drive wheel, so that said at least one calendar value of the display system is shifted by the calendar system when the fast correction system is not active, or by the correction system when it is active, without inducing stresses in the time measurement system and in that the elastic coupling means include two stop members pressed against the toothing of a star of the correction wheel set by two elastic strips, each stop member including a slide-block cooperating with a slide-way integral with the drive wheel to guide the movement of the elastic coupling means and to transmit the motion of the drive wheel to said at least one calendar value of the display system.

Advantageously according to the invention, it is understood that the correction or setting system can therefore correct the calendar display at any time without inducing stress in the gear train liable to interfere with the working of the time measurement system. It is to be noted in particular that no problems arise in coupling the correction system to a rotating gear train. Finally, the correction system is advantageously very compact.

In accordance with other advantageous features of the invention:

- the slide-way is arranged in the thickness of the drive wheel in order to decrease the thickness of said mechanism;
- the elastic strips are bent and each connect the two stop members on either side to form a substantially annular part;
- the fast correction system further includes a reduction device coupled to the correction wheel set;
- the reduction device is of the epicyclic train type, a pinion of the correction wheel set forming the inner planetary wheel and two satellite wheels mounted between said pinion and an outer planetary wheel forming the reduction means;
- the reduction device includes at least one wheel-pinion assembly forming the reduction means;
- the display system is of the dragging, instantaneous or semi-instantaneous type;
- said predetermined step is proportional to the number of teeth of the star of the correction wheel set;
- the display of said at least one time related value and/or said at least one calendar related value is of the type with a hand or of the type with a disc;
- said predetermined step is 12 hours or 24 hours.

Moreover, the invention relates to a timepiece, characterized in that it includes a mechanism according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 2:
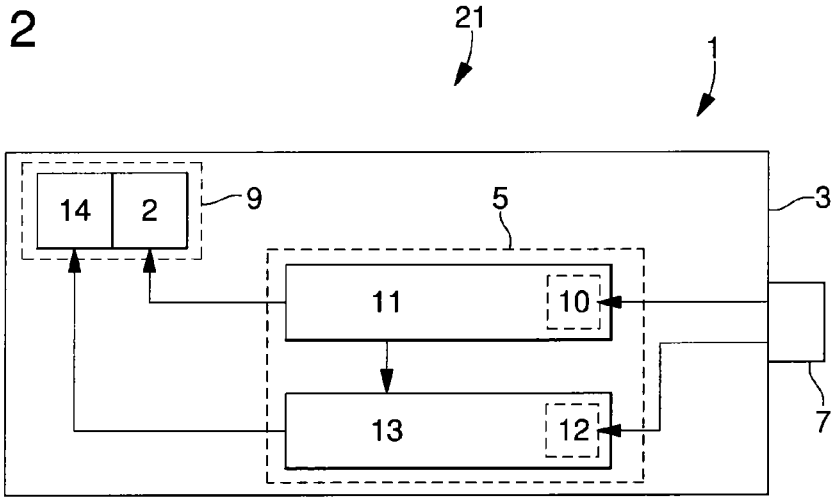
FIG. 2 is a function diagram of a mechanism according to the invention.
Figure 3:
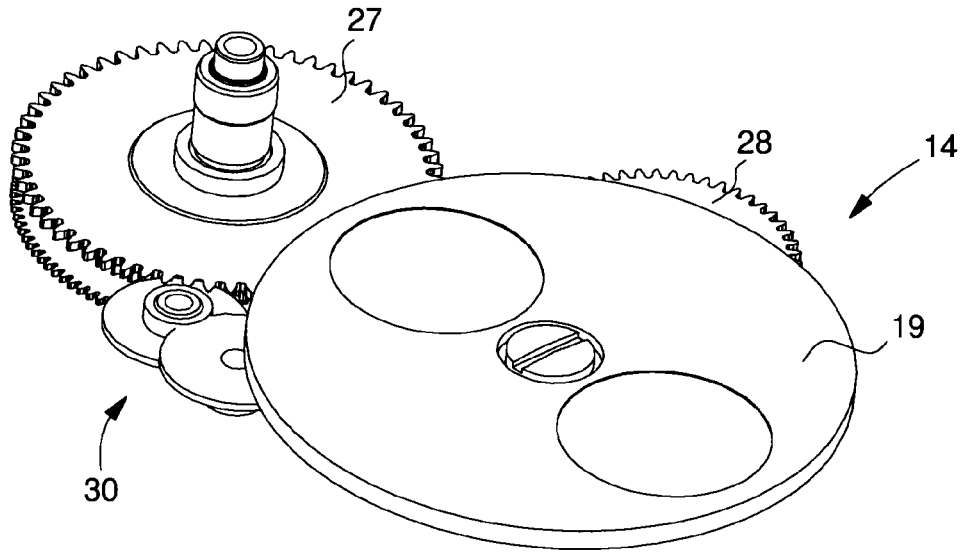
FIG. 3 is a perspective top view of one part of a mechanism according to the invention.
Figure 4:
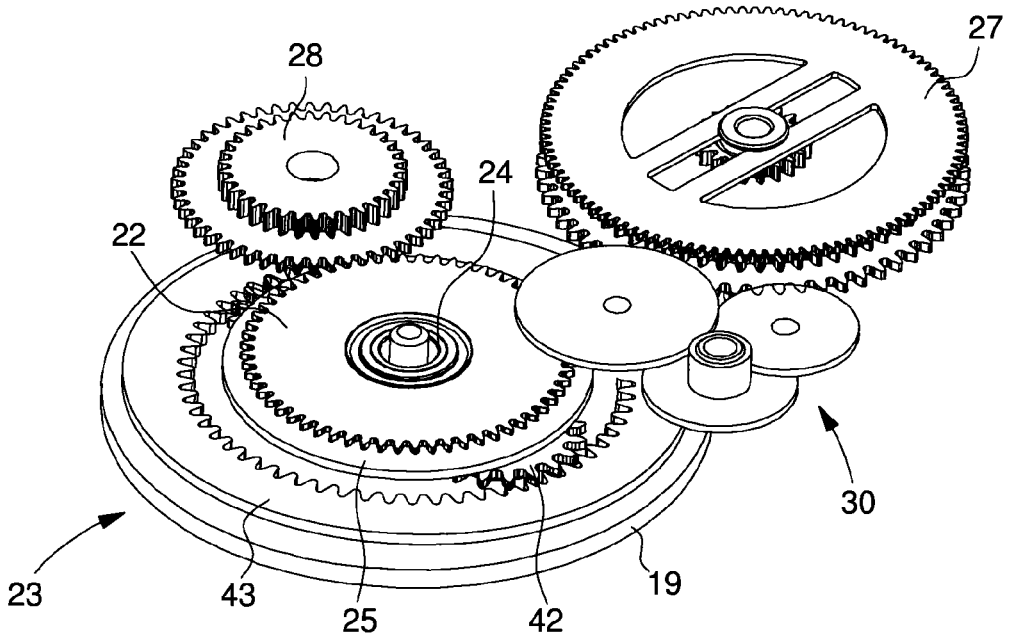
FIG. 4 is a perspective bottom view of one part of a mechanism according to the invention.
Figure 5:
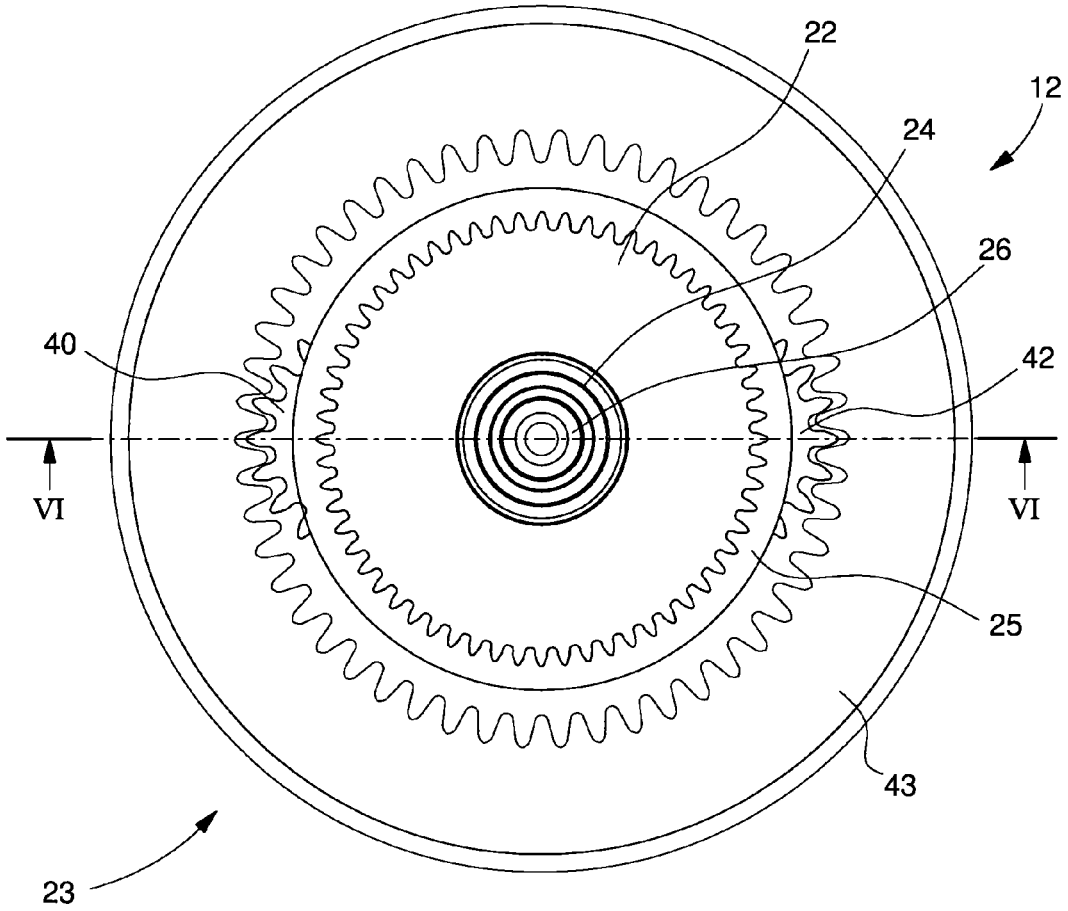
FIG. 5 is a bottom view diagram of one part of a mechanism according to the invention.

The example illustrated in FIG. 2 shows a schematic diagram of a mechanical part 1 according to the invention. It includes a case 3 inside which is mounted a mechanical movement 5 controlled by at least one control member 7, which preferably projects from case 3 and enables correction or setting of a display device 9 of mechanical part 1.

The mechanism 21 according to the invention includes movement 5, display system 9 and a fast correction or setting system 10, 12. In the example illustrated in FIG. 2, movement 5 includes a measurement system 11, 13 mechanically connected to the display system 9 intended to display a piece of time or calendar related information. Measurement system 11, 13 includes fast correction or setting system 10, 12 which makes it possible to correct or set, at any time and in a predetermined step, said display 2, 14 of time or calendar related information while maintaining the connection of display system 9 to measurement system 11, 13 during the correction phase.

As explained above, measurement system 11, 13 is not limited to a system displaying time or calendar related information. Thus, by way of example, advantageously according to the invention, the correction or setting system 10, 12 explained below may also be applied to a measuring system displaying non time related data such as altitude, i.e. underwater depth or height above water, or even temperature.

Figure 1:
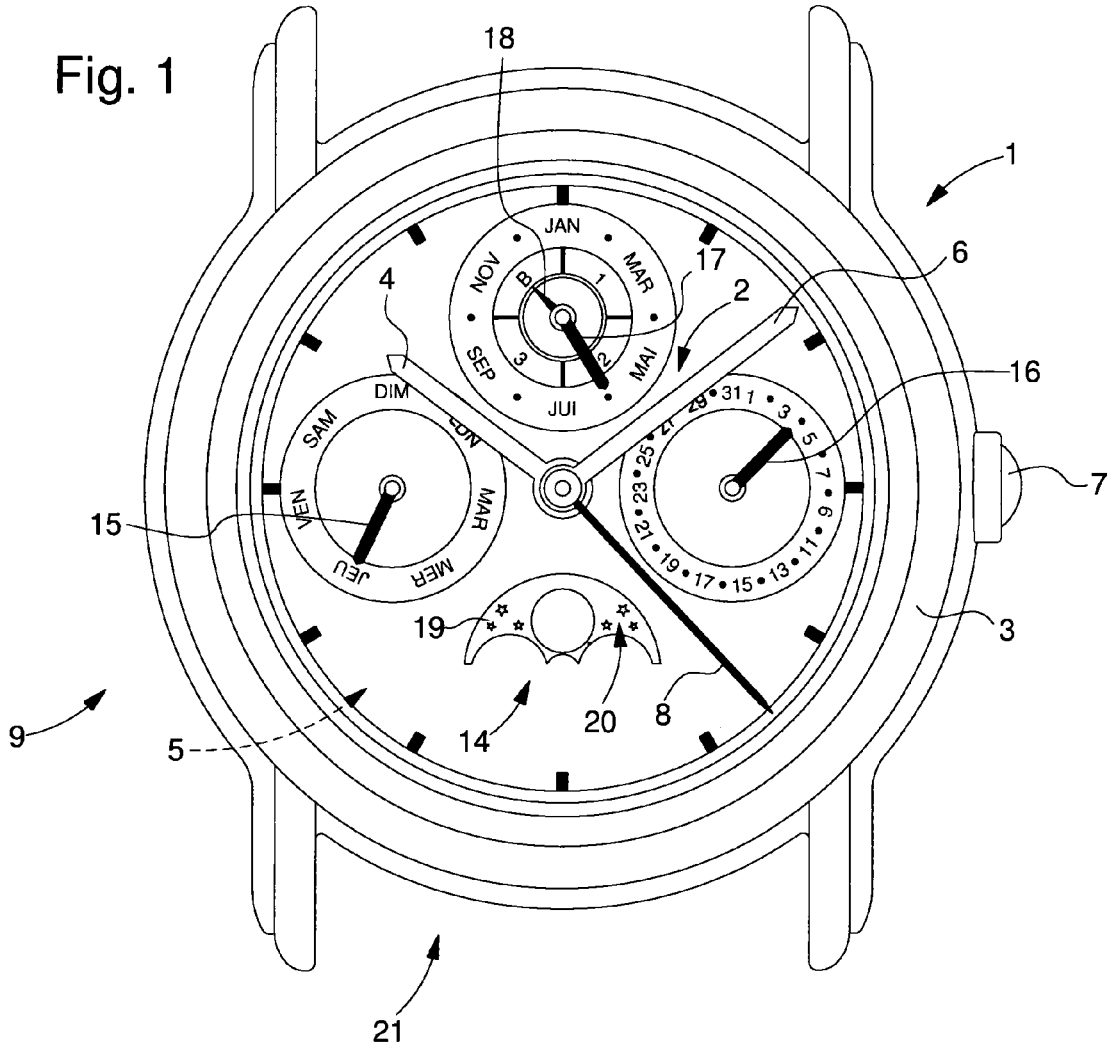
FIG. 1 is a diagram of a timepiece according to the invention.

By way of example, mechanism 21 may include a timepiece movement 5, that is to say which includes a time measurement system 11 for displaying the time 2 and a calendar system 13 connected to time measurement system 11 and intended to display a calendar value. Time measurement system 11 is intended to drive the moving parts of time display 2. In the example illustrated in FIGS. 1 and 2, mechanical part 1 is a timepiece. Display system 9 of timepiece 1 includes a time display 2 of the type with a moving hand 4, 6, 8 and an hour circle. Time measurement system 11 also includes a correction or setting system 10 allowing the moving parts 4, 6 of display 2 to be modified by actuation of control member 7.

Calendar system 13 is intended to drive the moving parts of calendar display 14. In the example illustrated in FIGS. 1 and 2, display system 9 of timepiece 1 includes a calendar display 14 of the type with a moving hand 15, 16, 17, 18 and/or disc 19 through an aperture 20. Calendar system 13 also includes a correction or setting system 12 allowing said moving parts 15, 16, 17, 18, 19 of display 14 to be modified, also by actuation of control member 7 or by another dedicated correction member. Control member 7 thus preferably controls both correction or setting systems 10 and 12 of movement 5.

Advantageously according to the invention, calendar system 13 and/or time measurement system 11 can comprise display means 2, 14 of either the dragging, instantaneous or semi-instantaneous type. In a non-limiting manner, calendar system 13 can display the day via a hand 15, the date via a hand 16, the month via a hand 17, the type of year (leap year or year 1, 2 or 3) via a hand 18 and the phase of the moon via a disc 19.

Further, preferably calendar system 13 includes a correction or setting system 12 explained below. However, it can perfectly well be applied to correction or setting system 10 of time measurement system 11 or to another system for measuring time related or not time related information.

Advantageously according to the invention, fast correction or setting system 12 makes it possible to modify display 14, preferably in a predetermined step such as, for example, of 12 or 24 hours, at any time of day, i.e. including around midnight, while maintaining the relationship between the motion of the calendar mechanism relative to that of the time during the correction operation, i.e. the connection of display system 9 to calendar system 13 or measurement system 11.

In a non-limiting manner, a correction or setting system 12 according to the invention is shown in FIGS. 3 to 7. It is thus clear that the example correction or setting system 12 in FIGS. 3 to 7, which is applied to a moon phase display 19 using a disc, may also be applied respectively to the display of another piece of time related or not time related information, with a different type of predetermined step and a different type of display member.

Preferably according to the invention, correction system 12 includes a correction wheel set 23 connected to display system 9 formed by moon phase disc 19. As better illustrated in FIGS. 6 and 7, correction wheel set 23 is formed by a correction wheel 22 fixed to a star 24 which is itself fitted onto a pinion 26. As visible in FIGS. 3 and 4, correction wheel 22 meshes with an intermediate wheel 28 driven by control member 7 during the correction phases.

Correction or setting system 12 further includes a drive wheel 25 mounted for free rotation on correction wheel set 23. Further, as suggested in FIGS. 3 and 4, drive wheel 25 includes a peripheral toothing meshing with intermediate wheels 30 at the 24 hour wheel 27 of calendar system 13. It is thus clear that drive wheel 25 is permanently connected to calendar system 13. Correction or setting system 12 thus prevents calendar system 13 being uncoupled from time measurement system 11, which prevents any discrepancy between the advance of the moon phase 19 of display means 14 and hands 4, 6 of display 2. Consequently, advantageously according to the invention, display device 9 is always synchronised.

Finally, correction or setting system 12 includes elastic coupling means 29 between correction wheel set 23 and drive wheel 25 so that display system 9 can be moved either by calendar system 13 or by correction or setting system 12 without inducing stress in calendar system 13.

More precisely, elastic coupling means 29 include two stop members 31, 33 pressed against the toothing of star 24 of correction wheel set 23 by two elastic strips 32, 34. As visible in the example of FIG. 7, the elastic strips 32, 34 may be bent and each connect the two stop members 31, 33 on either side so as to form a substantially annular one-piece part.

Further, each stop member 31, 33 includes a slide-block 35, 37 cooperating with a slide-way 36, 38 arranged in the thickness of drive wheel 25 in order to guide the movement of elastic coupling means 29 and to transmit the motion of drive wheel 25 to display system 14.

Figure 6:
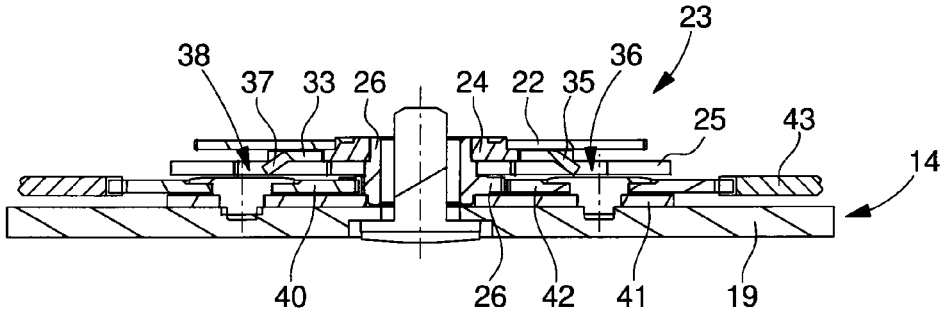
FIG. 6 is a cross-section along the axis VI-VI of FIG. 5.
Figure 7:
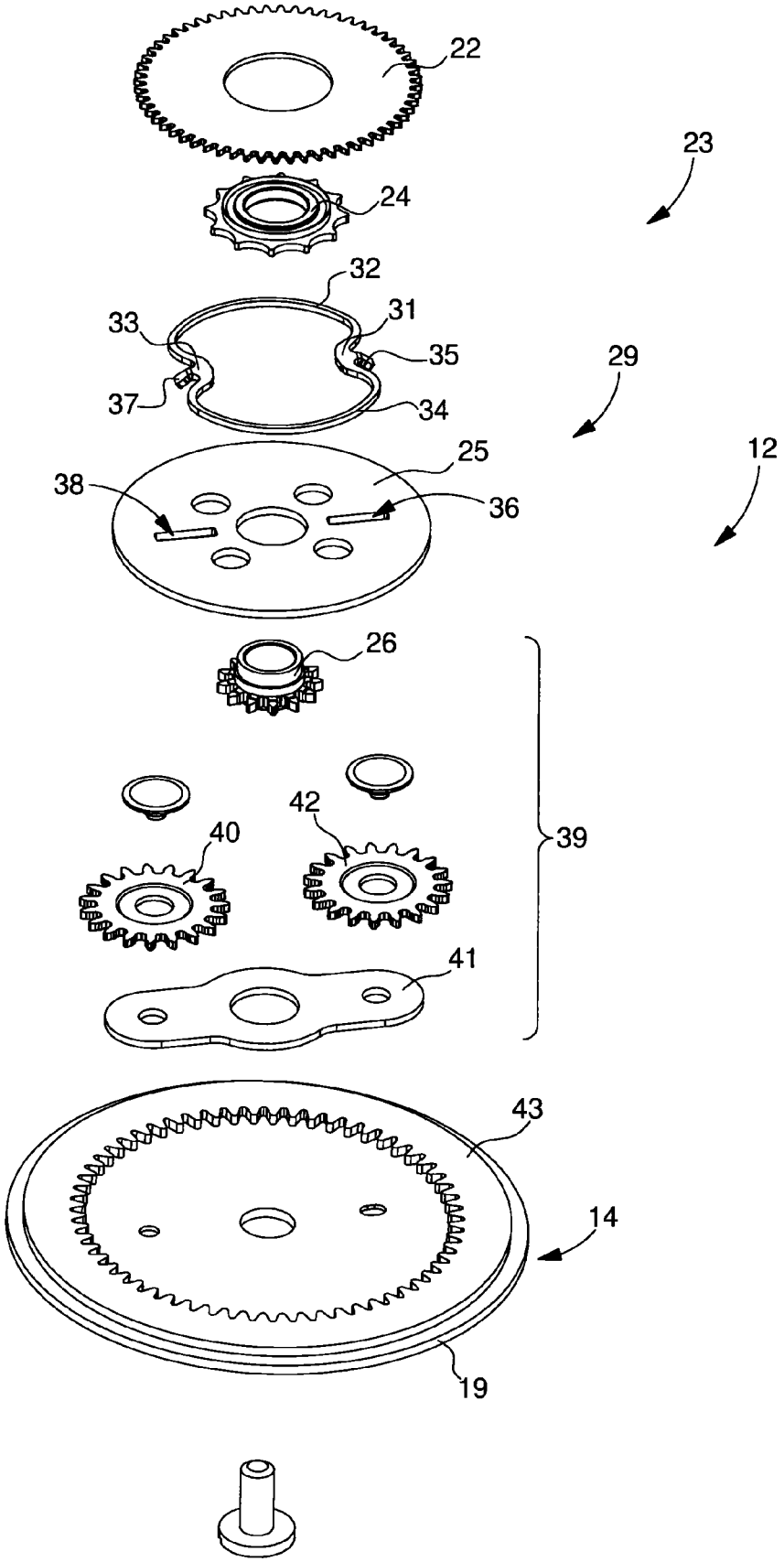
FIG. 7 is an exploded view of FIG. 5.

According to a preferred embodiment, fast correction or setting system 12 further includes a reduction device 39 coupled to correction wheel set 23 to obtain sufficient precision to correct a moon phase. As seen in FIGS. 6 and 7, reduction device 39 is of the type with an epicyclic train. Pinion 26 of correction wheel set 23 thus forms the inner planetary wheel. Two satellites 40, 42 are pivotally mounted on a satellite-holder 41 integral with moon phase disc 19. The two satellites 40, 42 are meshed between pinion 26 and an outer planetary wheel 43 integral with a fixed element of mechanism 21.

The operation of calendar system 13 will now be explained. Calendar system 13 operates in two modes which can advantageously operate together: a first calendar display mode which is permanent, and a second calendar display correction mode, which can operate at the same time. In both modes, it is important to note that calendar system 13 and time measurement system 11 are permanently connected so as to maintain a constant relationship between the continuous movement of calendar display 14 relative to time display 2 including during the change into correction mode.

In display mode, time measurement system 11 provides elapsed-time related information to calendar system 13 which drives 24 hour wheel 27 at a rate of one revolution per day. Since the two stop members 31, 33 are pressed by the two elastic strips 32, 34 against the toothing of star 24 of correction wheel set 23, drive wheel 25 thus drives in rotation the assembly of correction wheel set 23—elastic coupling means 29 via intermediate wheels 30.

Indeed, each slide-way 36, 38 arranged in the thickness of drive wheel 25 requires each associated slide-block 35, 37, to impart the same rotational motion and, incidentally, by its star 24 to correction wheel set 23 to eventually transmit the motion to display system 9 via reduction device 39. Since moon phase disc 19 is integral with satellite holder 41, it makes a continuous rotation indicating the progress of the lunation.

To change into correction mode, control member 7 is actuated to act on correction or setting system 12. Control member 7 will then actuate intermediate wheel 28. The movement of latter, transmitted by correction wheel 22, then star 24, will force elastic coupling means 29 and particularly its stop members 31, 33 to move away so as to allow a relative motion between star 24 and drive wheel 25, for the purpose of correcting display 14 integral with pinion 26 without affecting the continuous rotation of drive wheel 25 of the display mode. Advantageously, it is clear that the movement of each stop member 31, 33 is guided by the sliding of its slide-block 35, 37 in its associated slide-way 36, 38.

As explained above, advantageously, depending on the number of teeth of star 24, each tooth passed by elastic coupling means 29 permits correction in the predetermined step. Thus, the combination of 12 teeth of star 24 in the example of FIG. 7 with reduction device 39 enables one 24 hour step of display 14 to be made. Then, by hindering control member 7, elastic coupling means 29 enable the orientation of correction wheel set 23 to be elastically readjusted with respect to that of drive wheel 25.

Consequently, advantageously according to the invention, in the example of the display of a moon phase 19, depending on the number of teeth of star 24, it is possible to correct the display more simply, in a 12 hours or 24 hours step, in a single correction step although the moon phase has a cycle of 29.53 days.

Of course, the present invention is not limited to the illustrated example but is capable of various variants and alterations that will appear to those skilled in the art. In particular, the time or calendar related information display 2, 14 is not limited to a hand or a disc. By way of example, the display could be of the type with a drum.

It is also possible to envisage modifying star 24 and/or reduction device 39 to make a different step value of display 14 regardless of whether the information is time related or not time related.

Likewise, control member 7 of correction or setting system 12 may be different for correction or setting system 10 of time measurement system 11 and may equally well be a push-piece or a crown.

FIG. 7 shows slide-ways 36, 38 which are arranged in the thickness of drive wheel 25 to reduce the thickness of said mechanism. However, it is also possible to provide that these slide-ways 36, 38 are integral with drive wheel 25, i.e. slide-ways 36, 38 are added as protruding parts and secured to the upper face of drive wheel 25.

Finally, reduction device 39 is not limited to an epicyclic gear or even to the use of two satellites 40, 42. Indeed, reduction device 39 could include only one satellite or more than two satellites. Further, it is perfectly possible to replace the epicyclic gear with a more conventional gear using at least one wheel-pinion assembly. It is thus seen that pinion 26 could be directly integral with display 14 and intermediate wheel 28 could become the reduction gear device which allows correction of display 14 in a predetermined step at each relative motion between star 24 and drive wheel 25.

What is claimed is:

1. A timepiece mechanism comprising:

a time measurement system and a calendar system connected to the time measurement system, the time measurement and calendar systems each being connected to a display system for displaying at least one time related value and at least one calendar related value, and a fast calendar correction system for correcting at any time and in predetermined steps the display of the at least one calendar value while maintaining the at least one time related value and the connection of the display system to the time measurement and calendar systems during the correction phase, wherein the fast calendar correction system includes a correction wheel set connected to the display system, a drive wheel mounted for free rotation on the correction wheel set and permanently connected to the time measurement system, and elastic coupling means between the correction wheel set and the drive wheel, so that the at least one calendar value of the display system is shifted by the calendar system when the fast calendar correction system is not active, or by the fast calendar correction system when it is active, without inducing stresses or movements in the time measurement system and wherein the elastic coupling means include two stop members pressed against toothing of a star of the correction wheel set by two elastic strips, each stop member including a slide-block cooperating with a slide-way integral with the drive wheel to guide the movement of the elastic coupling means and to transmit the motion of the drive wheel only to the at least one calendar value of the display system.

2. The mechanism according to claim 1, wherein the slide-way is arranged in the thickness of the drive wheel in order to reduce the thickness of the mechanism.

3. The mechanism according to claim 1, wherein the elastic strips are bent and each connect the two stop members on either side in order to form a substantially annular one-piece part.

4. The mechanism according to claim 1, wherein the fast calendar correction system further includes a reduction device coupled to the correction wheel set.

5. The mechanism according to claim 4, wherein the reduction device is of the epicyclic train type, a pinion of the correction wheel set forming the inner planetary wheel and two satellites mounted between the pinion and an outer planetary wheel forming the reduction means.

6. The mechanism according to claim 4, wherein the reduction device includes at least one wheel-pinion assembly forming the reduction means.

7. The mechanism according to claim 1, wherein the display system is of the dragging, instantaneous or semi-instantaneous type.

8. The mechanism according to claim 1, wherein the predetermined step is proportional to the number of teeth of the star of the correction wheel set.

9. The mechanism according to claim 1, wherein the display of the at least one time related value and/or the at least one calendar related value is of the type with a hand.

10. The mechanism according to claim 1, wherein the display of the at least one time related value and/or the at least one calendar related value is of the type with a disc.

11. The mechanism according to claim 1, wherein the predetermined step is of 12 hours.

12. The mechanism according to claim 1, wherein the predetermined step is of 24 hours.

13. A timepiece wherein it includes a mechanism according to claim 1.

* * * * *